US010501230B2

(12) United States Patent
Lantz et al.

(10) Patent No.: US 10,501,230 B2
(45) Date of Patent: Dec. 10, 2019

(54) WOODEN PALLET WITH BUTTED DECK BOARDS AND RELATED METHODS

(71) Applicant: CHEP Technology Pty Limited, Sydney (AU)

(72) Inventors: Daniel J Lantz, Orlando, FL (US); Eric Kumor, Orlando, FL (US)

(73) Assignee: CHEP Technology Pty Limited, Sydney (AU)

( * ) Notice: Subject to any disclaimer, the term of this patent is extended or adjusted under 35 U.S.C. 154(b) by 0 days.

(21) Appl. No.: 16/044,630

(22) Filed: Jul. 25, 2018

(65) Prior Publication Data

US 2019/0047747 A1 Feb. 14, 2019

Related U.S. Application Data

(60) Provisional application No. 62/542,352, filed on Aug. 8, 2017.

(51) Int. Cl.
*B65D 19/00* (2006.01)

(52) U.S. Cl.
CPC ..... *B65D 19/0095* (2013.01); *B65D 2519/00029* (2013.01); *B65D 2519/00064* (2013.01); *B65D 2519/00099* (2013.01); *B65D 2519/00273* (2013.01); *B65D 2519/00293* (2013.01); *B65D 2519/00323* (2013.01); *B65D 2519/00333* (2013.01); *B65D 2519/00572* (2013.01); *B65D 2519/00796* (2013.01)

(58) Field of Classification Search
CPC ..... B65D 19/0095; B65D 2519/00333
USPC ..... 108/51.11, 57.17, 51.3, 56.1, 57.19
See application file for complete search history.

(56) References Cited

U.S. PATENT DOCUMENTS 3,204,583 A * 9/1965 Nicholson ..... B65D 19/0091 108/51.11
3,719,157 A * 3/1973 Arcocha ..... B65D 19/004 108/57.25
4,184,435 A * 1/1980 Shevchenko ..... B65D 19/0069 108/57.1
5,076,175 A * 12/1991 Whatley, II ..... B65D 19/38 108/51.11
5,351,628 A 10/1994 Breezer et al.
5,960,721 A * 10/1999 Huetteman ..... B65D 19/0095 108/57.17
6,584,915 B1 * 7/2003 Rogers ..... B65D 19/0095 108/51.11
8,261,673 B2 * 9/2012 Ingham ..... B65D 19/0095 108/51.11
8,627,773 B2 * 1/2014 Storteboom ..... B65D 19/38 108/51.11
8,707,874 B2 * 4/2014 Ritzberger ..... B65D 21/0235 108/51.11
9,038,546 B2 * 5/2015 Ten Bok ..... B65D 19/0048 108/57.17

(Continued)

*Primary Examiner* — Jose V Chen
(74) *Attorney, Agent, or Firm* — Allen, Dyer, Doppelt + Gilchrist, PA

(57) ABSTRACT

A pallet includes a base layer and a cargo layer. The cargo layer includes a pair of spaced apart end deck boards, and intermediate deck boards between the pair of spaced apart end deck boards. Each end deck board and an immediately adjacent intermediate deck board are butted against one another. Spaced apart support blocks are coupled between the base and cargo layers and forming a gap therebetween for receiving a lifting member.

16 Claims, 3 Drawing Sheets

(56) References Cited

U.S. PATENT DOCUMENTS

| | | | | |
|---|---|---|---|---|
| 2006/0005746 | A1* | 1/2006 | Gouldin, Jr. ..... | B65D 19/0091 108/51.11 |
| 2006/0254474 | A1* | 11/2006 | Roth ..... | B65D 19/0095 108/51.11 |
| 2008/0156234 | A1* | 7/2008 | van de Camp .... | B65D 19/0095 108/51.11 |
| 2008/0210140 | A1* | 9/2008 | Valentinsson ..... | B65D 19/0014 108/57.25 |
| 2010/0107933 | A1* | 5/2010 | Love ..... | B65D 19/0022 108/51.3 |
| 2010/0229765 | A1* | 9/2010 | Shafer ..... | B65D 19/0095 108/57.17 |
| 2011/0005435 | A1* | 1/2011 | Renck ..... | B65D 19/0095 108/57.17 |
| 2012/0260832 | A1 | 10/2012 | Linares | |
| 2013/0160680 | A1 | 6/2013 | Ten Bok | |
| 2014/0026790 | A1* | 1/2014 | Anderson ..... | B65D 19/0095 108/51.11 |
| 2015/0210425 | A1 | 7/2015 | Miller | |
| 2015/0360809 | A1 | 12/2015 | McBride et al. | |
| 2017/0190463 | A1 | 7/2017 | De Beer et al. | |
| 2018/0322453 | A1* | 11/2018 | Lantz ..... | G06Q 10/0833 |

* cited by examiner

WOODEN PALLET WITH BUTTED DECK BOARDS AND RELATED METHODS

RELATED APPLICATION

This application claims the benefit of U.S. Provisional Application Ser. No. 62/542,352 filed Aug. 8, 2017, the entire contents of which are incorporated herein by reference.

TECHNICAL FIELD

The present disclosure relates to the field of pallets, and more particularly, to a wooden pallet having an improved resilience to impacts from material handling equipment, and to related methods for making the same.

BACKGROUND

Conventional wooden pallets include a base layer and a cargo layer separated by support blocks. The cargo layer traditionally has end deck boards assembled on connector boards that run the full length or width of the pallet. The end deck boards are nailed through the connector boards into the support blocks to build the primary structure of the pallet. The end deck boards are also known as lead boards. Intermediate deck boards are placed between the end deck boards.

To move the pallet with cargo thereon, forklift tines are inserted into the gaps between the base and cargo layers. If the forklift is not stopped in time, the forklift may crash into one of the end deck boards of the pallet. The end deck board may not be able to withstand such an impact over time. Accidents such as this weaken the pallet and greatly shorten the lifespan of the pallet, thereby causing the pallet to be repaired more frequently and/or removed from service long before its anticipated life cycle has been reached.

SUMMARY

A wooden pallet includes a base layer, a cargo layer, and a plurality of spaced apart support blocks coupled between the base and cargo layers and forming a gap therebetween for receiving a lifting member. The cargo layer includes a pair of spaced apart connector boards, and a pair of spaced apart end deck boards on the plurality of connector boards. The end deck boards are orthogonal to the pair of connector boards. A pair of spaced apart intermediate deck boards is on the pair of connector boards. Each intermediate deck board is orthogonal to the pair of connector boards and butted against a respective end deck board.

Wooden pallet durability is significantly improved by having the end deck boards butt up against the immediately adjacent intermediate deck boards. A wooden pallet with butted deck boards thus has an improved resilience to impacts from material handling equipment.

Each intermediate deck board and end deck board has a same width. In another embodiment, each intermediate deck board and end deck board has a different width. The cargo layer further includes at least one additional intermediate deck board between the pair of intermediate deck boards, with the at least one additional intermediate deck board being spaced from the pair of intermediate deck boards.

The plurality of support blocks comprise corner support blocks and center support blocks between the corner support blocks, with the corner support blocks and the center support blocks each having a rectangular shape. The center support blocks are orthogonal to the corner support blocks.

The base layer comprises a pair of bottom end deck boards and a bottom center deck board between the pair of bottom end deck boards, with a width of the bottom center deck board being greater than a width of the bottom end deck boards. The bottom end deck boards and the bottom center deck board are aligned with the end deck boards and the intermediate deck board.

Each corner support block has spaced apart upper and lower surfaces, and angled edges extending between the upper and lower surfaces. The outer corners of each end deck have angled edges aligned with the angled edges of the corner support blocks. The base layer comprises a pair of bottom end deck boards and a bottom center deck board between the pair of bottom end deck boards, with outer corners of each bottom end deck board having angled edges aligned with the angled edges of the corner support blocks.

The base layer comprises a plurality of bottom deck boards, with each bottom deck board coupled to at least two support blocks, and having beveled edges between the pair of support blocks and non-beveled edges at each respective support block.

Another aspect is directed to a method for making a wooden pallet comprising providing a base layer, providing a cargo layer, and coupling a plurality of spaced apart support blocks between the base and cargo layers and forming a gap therebetween for receiving a lifting member. The cargo layer includes a pair of spaced apart connector boards, and a pair of spaced apart end deck boards on the pair of connector boards, with the end deck boards being orthogonal to the pair of connector boards. A pair of spaced apart intermediate deck boards is on the pair of connector boards, with each intermediate deck board being orthogonal to the pair of connector boards and butted against a respective end deck board.

DETAILED DESCRIPTION

The present description is made with reference to the accompanying drawings, in which exemplary embodiments are shown. However, many different embodiments may be used, and thus the description should not be construed as limited to the particular embodiments set forth herein. Rather, these embodiments are provided so that this disclosure will be thorough and complete. Like numbers refer to like elements throughout.

Figure 1:
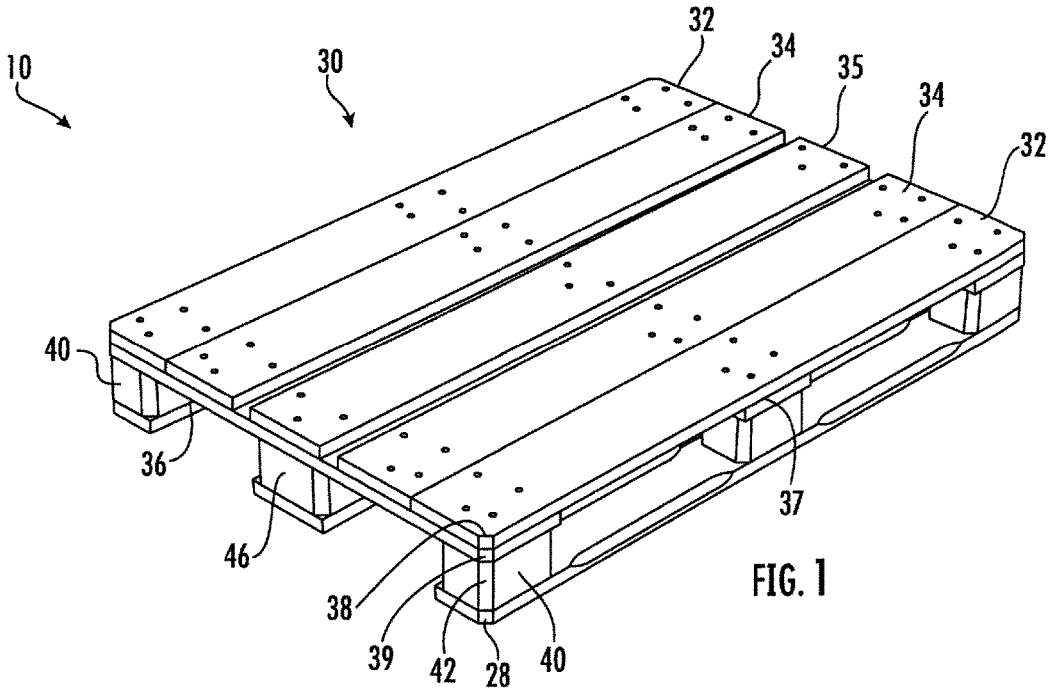
FIG. 1 is a top perspective view of a wooden pallet with butted deck boards in accordance with the disclosure.
Figure 2:
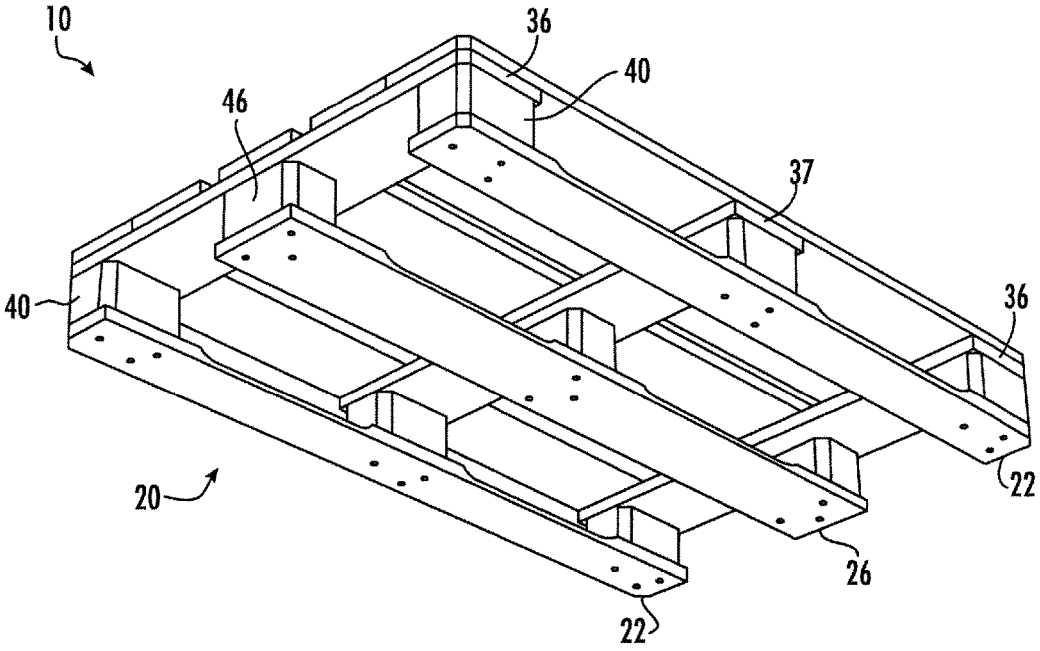
FIG. 2 is a bottom perspective view of the wooden pallet shown in FIG. 1.
Figure 3:
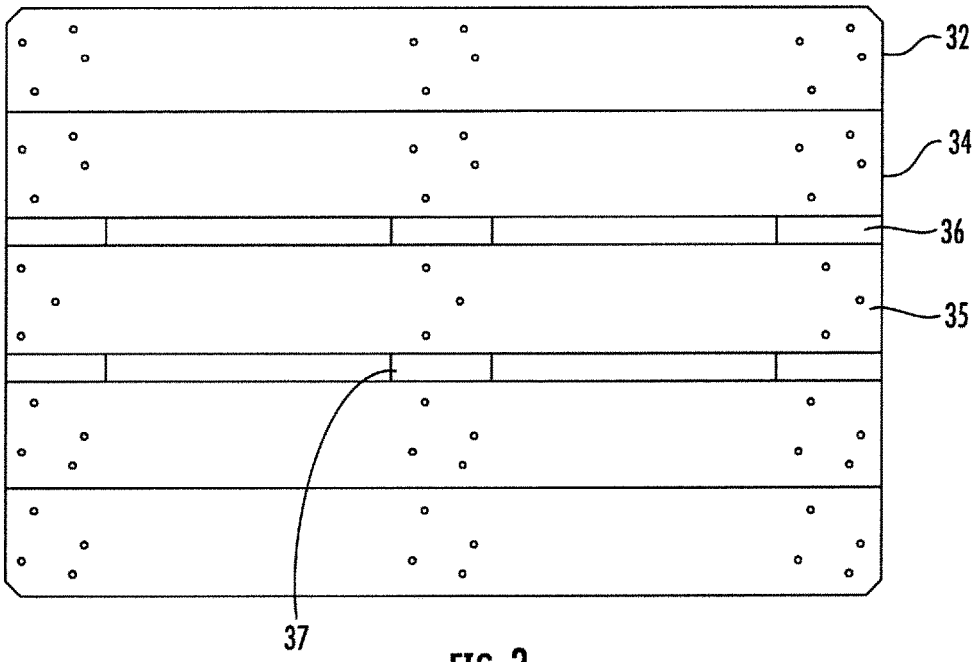
FIG. 3 is a top view of the wooden pallet shown in FIG. 1.
Figure 4:
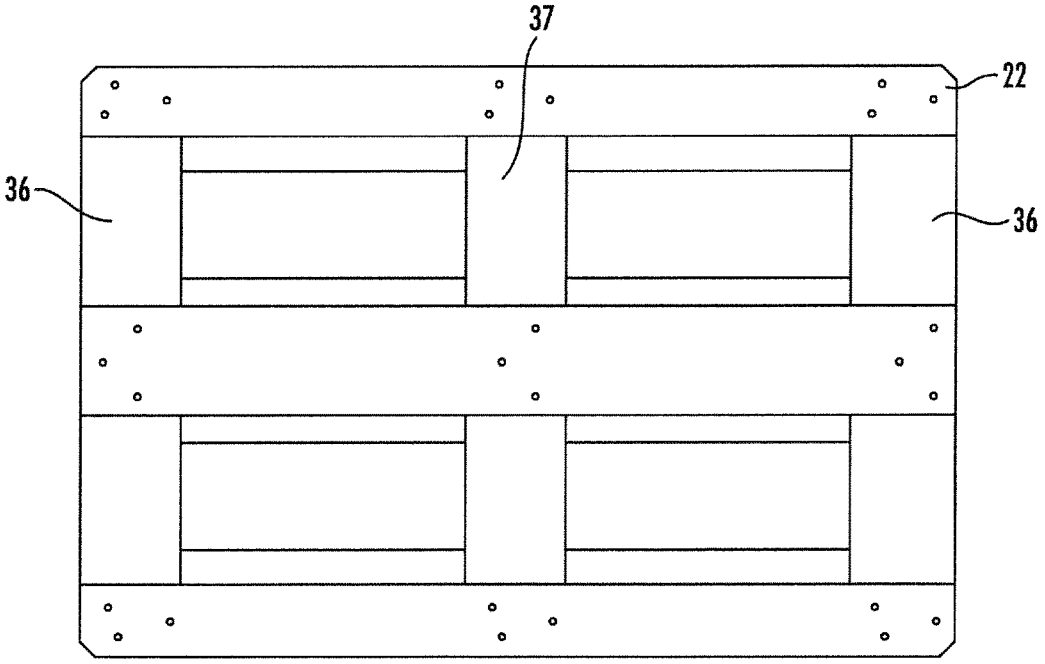
FIG. 4 is a bottom view of the wooden pallet shown in FIG. 1.
Figure 5:
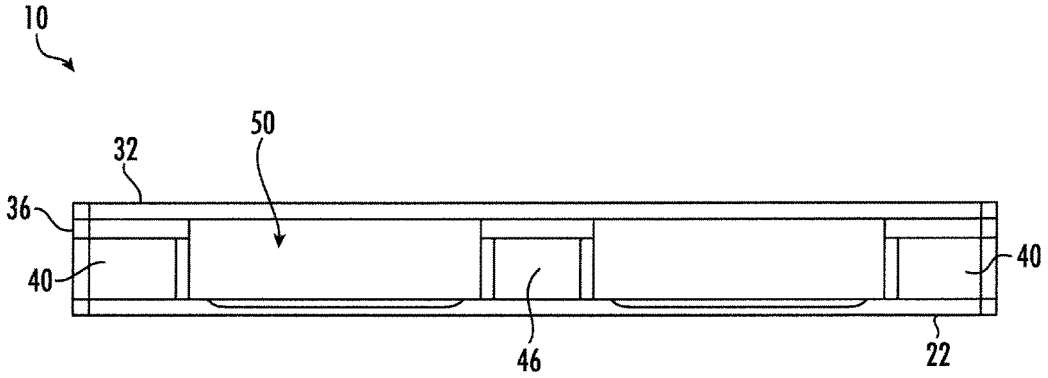
FIG. 5 is an end view of the wooden pallet shown in FIG. 1.
Figure 6:
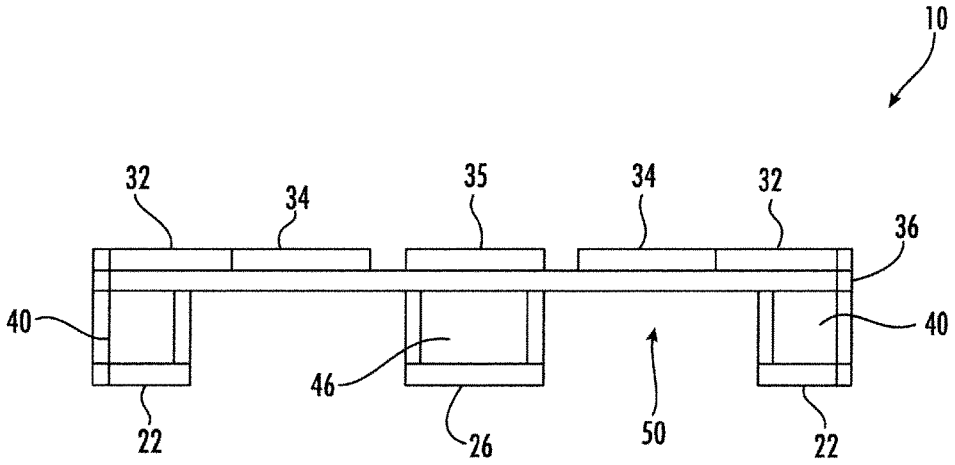
FIG. 6 is a side view of the wooden pallet shown in FIG. 1.

Referring to FIGS. 1-6, the illustrated wooden pallet 10 includes a base layer 20, a cargo layer 30, and a plurality of wooden support blocks 40, 46 coupled between the base and cargo layers. The support blocks 40, 46 form a gap 50 between the base and cargo layers 20, 30 for receiving a lifting member, such as fork lift tines.

The cargo layer 30 includes a pair of spaced apart wooden end deck boards 32, and a pair of wooden intermediate deck boards 34 between the end deck boards. More particularly, each end deck board 32 and an immediately adjacent intermediate deck board 34 are butted against one another. Pallet durability is significantly improved by having the end deck boards 32 butt up against the immediately adjacent intermediate deck boards 34.

Also included within the cargo layer 30 are a pair of spaced apart wooden connector boards 36 and a wooden intermediate connector board 37. The connector boards 36 and the intermediate connector boards 37 are orthogonal to the end deck boards 32 and the intermediate deck boards 34. The end deck boards 32 and the intermediate deck boards 34 are positioned on the connector boards 36.

The base layer 20 includes bottom deck boards 22, 26 orientated in the same direction as the end deck boards 32 and the intermediate deck boards 34 in the cargo layer 30. The bottom deck boards 22, 26 are directly coupled to the support blocks 40, 46.

The illustrated support blocks include corner support blocks 40 and center support blocks 46 between the corner support blocks 40. The corner support blocks 40 and the center support blocks 46 each have a rectangular shape, and with the center support blocks 46 being orthogonal to the corner support blocks 40. A rectangular shape has unequal adjacent sides so that a length and width of a rectangular shaped corner support block 40 are not equal as in a square shaped corner support block 40.

The bottom deck boards include a pair of bottom end deck boards 22 and a bottom center deck board 26 between the pair of bottom end deck boards 22. A width of the bottom center deck board 26 is greater than a width of the bottom end deck boards 22.

In other embodiments, the corner support blocks 40 and the center support blocks 46 may have a square or circular shape. When the support blocks 40, 46 are the same size, then a width of the bottom center deck board 26 is equal to a width of the bottom end deck boards 22.

In the illustrated wooden pallet 10, a size of each end deck board 32 and a corresponding intermediate deck board 34 butted thereagainst have the same dimensions. For example, a width of the end deck board 32 and the intermediate deck board 34 butted thereagainst may be 145 mm, for example. In another example, the width may be 78 mm.

In other embodiments, the size of each end deck board 32 and a corresponding intermediate deck board 34 have different dimensions. For example, the width of the end deck board 32 may be 78 mm and the width of the corresponding intermediate deck board 34 may be 98 mm.

Traditionally, the intermediate deck boards in wooden pallets have a width that is less than a width of the end deck boards. In addition, traditionally there is a gap between the end deck boards and the adjacent intermediate deck boards. In the illustrated wooden pallet 10, pallet durability is significantly improved when there is no gap between the end deck boards 32 and the immediately adjacent intermediate deck boards 34, particularly with the end deck boards 32 and the immediately adjacent intermediate deck boards 34 having a same width.

The cargo layer 30 also includes at least one additional intermediate deck board 35 positioned between the intermediate deck boards 34 that are butted against the end deck boards 32. This additional intermediate deck board 35 is positioned so that there is a gap between the adjacent intermediate deck boards 34. The dimensions of the end deck boards 32 and the intermediate deck boards 34 as well as additional intermediate deck boards 35 positioned between the intermediate deck boards 34 are selected and spaced such that coverage of the cargo layer 30 is within a range of 70-85 percent of a maximum total surface area of the cargo layer 30 when there are no gaps between the boards.

A width of the intermediate deck board 35 may be the same as a width of the intermediate deck boards 34 butted against the end deck boards 32. Alternatively, in other embodiments, this intermediate deck board 35 may have a different width.

As noted above, the illustrated wooden pallet 10 also includes center support blocks 46 between the corner support blocks 40. When the support blocks 40, 46 are rectangular shaped, the center support blocks 46 may be positioned in a different orientation to the corner support blocks 40. In other words, the center support blocks 46 may be at a 90 degree angle to the corner support blocks 40. In other embodiments, orientation of the center support blocks 46 is the same as orientation of the corner support blocks 40.

Another feature of the illustrated wooden pallet 10 is the edges of each support block 40 being angled or chamfered. The angled edges 42 may be within a range of about 25 to 75 degrees, for example, to deflect the impact force of the forklift tines should such an impact occur. The illustrated edges are angled at 45 degrees.

When the edges 42 of each support block 40 are angled, the corresponding outermost edges 38 of the end deck boards 32 are angled to match the angled edges 42 in the support blocks 40. The corresponding outermost edges 39 of the connector boards 36 in the cargo layer 30 are angled to also match the angled edges 42 in the support blocks 40. The corresponding outermost edges 28 of the deck boards 22 in the base layer 20 are also angled to match the angled edges 42 in the support blocks 40.

Another aspect of the disclosure is directed to making a wooden pallet 10 comprising a base layer 20, and a cargo layer 30, and a pair of spaced apart connector boards 32 orthogonal to the pair of spaced apart end deck boards. The method includes forming the cargo layer 30 such that the cargo layer comprises a pair of spaced apart end deck boards 32, and a pair of intermediate deck boards 34 between the pair of spaced apart end deck boards, with each end deck board 32 and an adjacent intermediate deck board 34 butted against one another. The method further includes coupling a plurality of spaced apart support blocks 40 between the base and cargo layers 20, 30 and forming a gap therebetween for receiving a lifting member.

Many modifications and other embodiments will come to the mind of one skilled in the art having the benefit of the teachings presented in the foregoing descriptions and the associated drawings. Therefore, it is understood that the disclosure is not to be limited to the specific embodiments disclosed, and that modifications and embodiments are intended to be included within the scope of the appended claims.

That which is claimed:

1. A wooden pallet comprising:

a base layer comprising a pair of bottom end deck boards and a bottom center deck board between said pair of bottom end deck boards, with a width of said bottom center deck board being greater than a width of said bottom end deck boards;

a cargo layer comprising a pair of spaced apart connector boards, a pair of spaced apart end deck boards on said pair of connector boards, with the end deck boards being orthogonal to said pair of connector boards, and a pair of spaced apart intermediate deck boards on said pair of connector boards, with each intermediate deck board being orthogonal to said pair of connector boards and butted against a respective end deck board; and a plurality of spaced apart support blocks coupled between said base and cargo layers and forming a gap therebetween for receiving a lifting member, said plurality of support blocks comprising corner support blocks and center support blocks between the corner support blocks, with said corner support blocks and said center support blocks each having a same sized rectangular shape, and with said center support blocks coupled to said bottom center deck board being orthogonal to said corner support blocks so that said center support blocks extend across the width of said bottom center deck board.

2. The wooden pallet according to claim 1 wherein each intermediate deck board and end deck board has a same width.

3. The wooden pallet according to claim 1 wherein said cargo layer further comprises at least one additional intermediate deck board between said pair of intermediate deck boards, with said at least one additional intermediate deck board being spaced from said pair of intermediate deck boards.

4. The wooden pallet according to claim 1 wherein said bottom end deck boards and said bottom center deck board are aligned with said end deck boards and said intermediate deck board.

5. The wooden pallet according to claim 1 wherein each corner support block has spaced apart upper and lower surfaces, and angled edges extending between the upper and lower surfaces.

6. The wooden pallet according to claim 5 wherein outer corners of each end deck board have angled edges aligned with the angled edges of said corner support blocks.

7. The wooden pallet according to claim 5 wherein outer corners of each bottom end deck board have angled edges aligned with one of the angled edges of said corner support blocks.

8. The wooden pallet according to claim 1 wherein each bottom deck board is coupled to at least two support blocks, and has beveled edges between said pair of support blocks and non-beveled edges at each respective support block.

9. A method for making a wooden pallet comprising:

providing a base layer comprising a pair of bottom end deck boards and a bottom center deck board between the pair of bottom end deck boards, with a width of the bottom center deck board being greater than a width of the bottom end deck boards;

providing a cargo layer comprising a pair of spaced apart connector boards, a pair of spaced apart end deck boards on the pair of connector boards, with the end deck boards being orthogonal to the pair of connector boards, and a pair of spaced apart intermediate deck boards on the pair of connector boards, with each intermediate deck board being orthogonal to the pair of connector boards and butted against a respective end deck board; and coupling a plurality of spaced apart support blocks between the base and cargo layers and forming a gap therebetween for receiving a lifting member, the plurality of support blocks comprising corner support blocks and center support blocks between the corner support blocks, with the corner support blocks and the center support blocks each having a same sized rectangular shape, and with the center support blocks coupled to the bottom center deck board being orthogonal to the corner support blocks so that the center support blocks extend across the width of the bottom center deck board.

10. The method according to claim 9 wherein each intermediate deck board and end deck board has a same width.

11. The method according to claim 9 wherein the cargo layer further comprises at least one additional intermediate deck board between the pair of intermediate deck boards, with the at least one additional intermediate deck board being spaced from the pair of intermediate deck boards.

12. The method according to claim 9 wherein the bottom end deck boards and the bottom center deck board are aligned with the end deck boards and the intermediate deck board.

13. The method according to claim 9 wherein each corner support block has spaced apart upper and lower surfaces, and angled edges extending between the upper and lower surfaces.

14. The method according to claim 13 wherein outer corners of each end deck board have angled edges aligned with the angled edges of the corner support blocks.

15. The method according to claim 13 wherein outer corners of each bottom end deck board have angled edges aligned with the angled edges of the corner support blocks.

16. The method according to claim 9 wherein each bottom deck board is coupled to at least two support blocks, and has beveled edges between the pair of support blocks and non-beveled edges at each respective support block.

* * * * *